US008910558B2

(12) United States Patent
Kent

(10) Patent No.: US 8,910,558 B2
(45) Date of Patent: Dec. 16, 2014

(54) FIREARM RECOIL MODIFYING DEVICE

(71) Applicant: Howard D. Kent, Simi Valley, CA (US)

(72) Inventor: Howard D. Kent, Simi Valley, CA (US)

( * ) Notice: Subject to any disclaimer, the term of this patent is extended or adjusted under 35 U.S.C. 154(b) by 5 days.

(21) Appl. No.: 13/723,637

(22) Filed: Dec. 21, 2012

(65) Prior Publication Data

US 2014/0173963 A1 Jun. 26, 2014

(51) Int. Cl.
*F41A 21/26* (2006.01)
*F41A 33/00* (2006.01)
*F41A 21/32* (2006.01)

(52) U.S. Cl.
CPC ..... *F41A 21/32* (2013.01); *F41A 33/00* (2013.01)
USPC ..... 89/14.5

(58) Field of Classification Search
CPC ..... F41A 21/36; F41A 21/28; F41A 21/38; F41A 21/08
USPC ..... 42/90, 107, 1.06, 79, 106; 89/1.7, 89/1.701, 1.703, 177, 14.2, 14.3, 14.5
See application file for complete search history.

(56) References Cited

U.S. PATENT DOCUMENTS

| | | | | | |
|---|---|---|---|---|---|
| 2,372,315 | A | * | 3/1945 | Catron | 89/14.3 |
| 3,208,348 | A | * | 9/1965 | Lee | 89/14.3 |
| 4,833,808 | A | * | 5/1989 | Strahan | 42/1.06 |
| 5,020,416 | A | * | 6/1991 | Tripp | 89/14.3 |
| 5,425,298 | A | * | 6/1995 | Coburn | 89/14.3 |
| 5,463,930 | A | * | 11/1995 | Bisping et al. | 89/29 |
| 5,698,810 | A | * | 12/1997 | Rose | 89/14.3 |
| 6,026,728 | A | * | 2/2000 | Guhring et al. | 89/14.5 |
| 8,387,299 | B1 | * | 3/2013 | Brittingham et al. | 42/90 |

* cited by examiner

*Primary Examiner* — Samir Abdosh
*Assistant Examiner* — John D Cooper
(74) *Attorney, Agent, or Firm* — Robert A. Parsons; Michael W. Goltry; Parsons & Goltry

(57) ABSTRACT

A firearm recoil modifying device includes a cylindrical body having a rearward end, a forward end, and a longitudinal axis extending therebetween. An adapter having a central aperture aligned with the longitudinal axis is coupled to the rearward end of the cylindrical body. An end cap is coupled to the forward end of the cylindrical body, and includes a central aperture aligned with the central aperture of the adapter along the longitudinal axis. A piston is carried within the interior volume of the cylindrical body for reciprocal movement between a rearward position and a forward position. The piston includes a central aperture aligned with the central apertures of the adapter and the end cap, along the longitudinal axis. A biasing member biases the piston into the rearward position.

17 Claims, 2 Drawing Sheets

RIMFIRE RECOIL INCREASER:

RIMFIRE RECOIL INCREASER.

FIREARM RECOIL MODIFYING DEVICE

FIELD OF THE INVENTION

This invention relates to firearm accessories. More particularly, the present invention relates to firearm accessories for effecting muzzle discharges.

BACKGROUND OF THE INVENTION

In the field of firearms, the propellant gases resulting in muzzle blast are typically considered detrimental to firearm handling and accuracy. Many devices have been developed to reduce the adverse effects, including muzzle brakes and recoil compensators to redirect propellant gases, thereby reducing recoil and muzzle rise during firing. Muzzle brakes are simple in concept and most often utilize slots, vents, holes, baffles, and similar structures to redirect and control the burst of gases that follows the departure of a projectile. In conventional muzzle brake designs, gases from the combustion of propellant depart the muzzle brake at an angle to the muzzle. This creates a force which helps to counteract the rearward movement of the barrel referred to as recoil, as well as the upward rise of the muzzle.

With this consideration in mind, small, light firearms, such as those using a rimfire .22 caliber cartridges, do not have much recoil or barrel climb when fired. Rimfire (0.22LR) training firearms are often used by military, police and civilians alike because of the low cost of the firearms themselves and the cartridges they use. These firearms, however, share the common feature that while they represent realistic practice in weapon handling, the absence of recoil and muzzle rise similar to those experienced in full power firearms reduces their effectiveness in training. In other words, use of rimfire or other small caliber firearms that have little or no recoil and barrel rise as training for use of larger caliber firearms is flawed due to the absence of recoil and barrel rise.

It would be highly advantageous, therefore, to remedy the foregoing and other deficiencies inherent in the prior art.

An object of the present invention is to provide a device attachable to the muzzle of a firearm for manipulation of the muzzle blast.

SUMMARY OF THE INVENTION

Briefly, to achieve the desired objects and advantages of the instant invention provided is a firearm recoil modifying device. The firearm recoil modifying device includes a cylindrical body having a rearward end, a forward end, and a longitudinal axis extending therebetween, the cylindrical body defining an interior volume. An adapter, having a rearward end for coupling to a muzzle of a firearm and a central aperture aligned with the longitudinal axis, is coupled to the rearward end of the cylindrical body. An end cap is coupled to the forward end of the cylindrical body, and includes a central aperture aligned with the central aperture of the adapter along the longitudinal axis. A piston is carried within the interior volume of the cylindrical body for reciprocal movement between a rearward position and a forward position. The piston includes a rearward end, a forward end, and a central aperture extending therethrough from the rearward end to the forward end and aligned with the central apertures of the adapter and the end cap, along the longitudinal axis. A biasing member biases the piston into the rearward position.

In yet another aspect, a method of modifying recoil of a firearm is provided. The method includes providing a firearm having a barrel with a muzzle and a firearm recoil modifying device. The firearm recoil modifying device is attached to the firearm by attaching the rearward end of the adapter to the barrel at the muzzle. The firearm is fired to generate combustion gasses and move the piston from the rearward position to the forward position. The piston moves from the forward position to the rearward position by action of the biasing member.

In further aspects, the step of moving the piston from the forward position to the rearward position with the biasing member includes the piston impacting the adapter to impart rearwardly directed forces to the barrel, simulating recoil.

In yet another aspect, the step of moving the piston to the forward position includes the piston impacting the end cap to impart forwardly directed forces to the barrel, reducing recoil.

BRIEF DESCRIPTION OF THE DRAWINGS

The foregoing and further and more specific objects and advantages of the invention will become readily apparent to those skilled in the art from the following detailed description of a preferred embodiment thereof, taken in conjunction with the drawings in which.

DETAILED DESCRIPTION OF A PREFERRED EMBODIMENT

Figure 1:
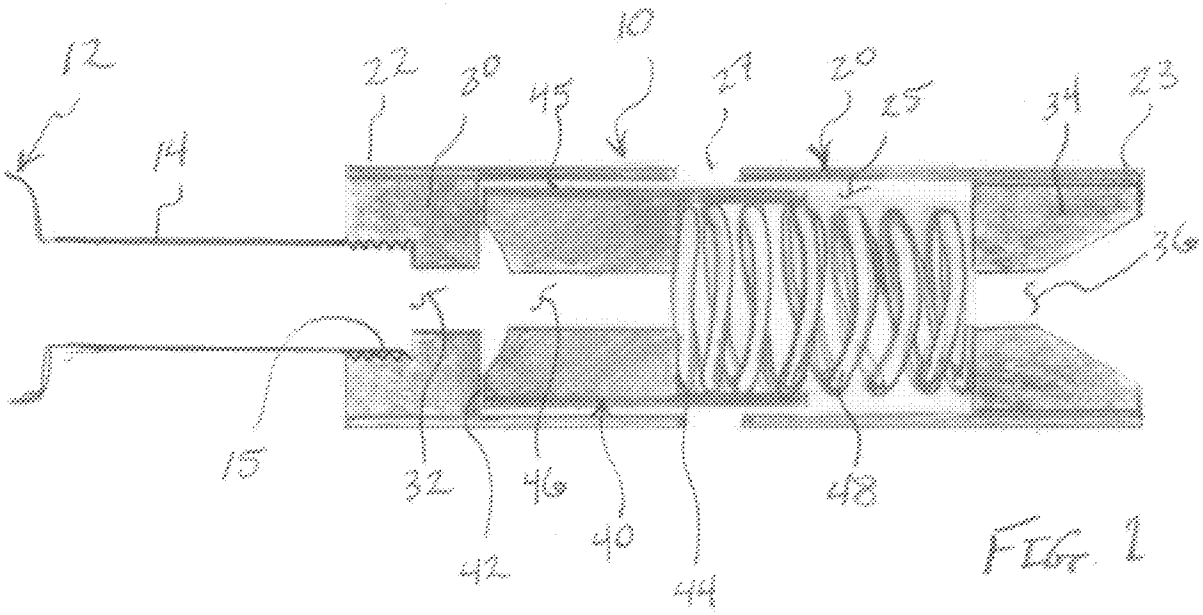
FIG. 1 is a simplified sectional side view of a firearm recoil modifying device according to the present invention.

Turning now to the drawings in which like reference characters indicate corresponding elements throughout the several views, attention is directed to FIG. 1 which illustrates a firearm recoil modifying device generally designated 10 removably coupled to a firearm 12 at muzzle end 14 of a barrel 15. The purpose of firearm recoil modifying device 10 is to harness the gases produced by combustion of propellant as a result of firing firearm 12 and to mechanically convert the energy of the gases into backward or forward impulses to barrel 15 of firearm 12. The impulses imparted to barrel 15 are transmitted through firearm 12 to the user. In addition, gases produced by firing may be radially vented in any selected direction or in all directions at once to force the barrel upward, downward or to remain stationary.

Firearm recoil modifying device 10 includes a cylindrical body 20 having a rearward end 22 (toward firearm 12), a forward end 23 (away from firearm 12) and a longitudinal axis extending therebwteen. Cylindrical body 20 defines an interior volume 25 and further includes vents 27 extending through cylindrical body 20 from interior volume 25 to an exterior environment. Vents 27 can be formed at substantially any orientation around the periphery of cylindrical body 20 relative firearm 12 (i.e. Top, bottom, sides) or equally around the periphery of cylindrical body 20. Vents 27 formed on the top of cylindrical body 20 relative firearm 12 will tend to force barrel 14 in a downward direction, while vents 27 formed on the bottom of cylindrical body 20 relative firearm 12 will tend to force barrel 14 in an upward direction. A vent blocking sleeve can be employed to permit selective blocking of vents to direct the exhaust flow, up, down, to one or both sides or to close them entirely as desired.

Still referring to FIG. 1, firearm recoil modifying device 10 further includes an adapter 30 coupled to and closing rearward end of cylindrical body 20. Adapter 30 includes a central aperture 32 permitting passage of fired bullet and propellant gases into interior volume 25 of cylindrical body 20. Adapter 30 has a rearward end 33 configured to be attached to muzzle 15 of barrel 14. It will be understood that attachment of adapter 30 to muzzle 15 can be accomplished in myriad manners such as by threaded engagement, quick release fasteners such as bayonet type fasteners, clamps or substantially any mechanism for attaching a structure to the muzzle of a firearm. Adapter 30 can be fixedly attached to rearward end 22 of cylindrical body 20 by employing a friction fit engagement, threaded engagement, welding, soldering, adhesives, crimped end and the like. Forward end 23 of cylindrical body 20 is closed by an end cap 34 which includes a central aperture 36 aligned with central aperture 32 along the longitudinal axis, to permitting passage of a fired bullet and propellant gases from interior volume 25 of cylindrical body 20.

A piston 40 is carried within volume 25 of cylindrical body 20 for reciprocal movement between a rearward position and a forward position. Piston 40 includes a rearward end 42 adjacent adapter 30, a forward end 44, an outer surface 45 positioned adjacent cylindrical body 20 and a central aperture 46 extending therethrough from rearward end 42 to forward end 44. Central aperture 46 is aligned with central apertures 32 and 36 along the longitudinal axis and permits passage of a fired bullet and propellant gases therethrough. Piston 40 is biased into the rearward position by a biasing member that can store energy as piston 40 is moved to the forward position, and release energy by moving piston 40 back to the rearward position. In the preferred embodiment, the biasing member is a compression spring 48 captured within interior volume 25 between forward end 44 of piston 40 and end cap 34. It will be understood that the biasing member can include one or more springs, coil springs, nested springs, belleville washers, pneumatic or hydraulic buffers, high temperature polymer bumpers and the like. When piston 40 is moved to the forward position, vents 27 are exposed, allowing egress of the gases within cylindrical body 20. End cap 34 can be made adjustable, such as by using a threaded engagement between end cap 34 and forward end 23 of cylindrical body 20. This allows the preloading tension on spring 48 to change, increasing or decreasing impact forces. Thus, recoil can be increased or decreased as desired.

Figures 2, 3:
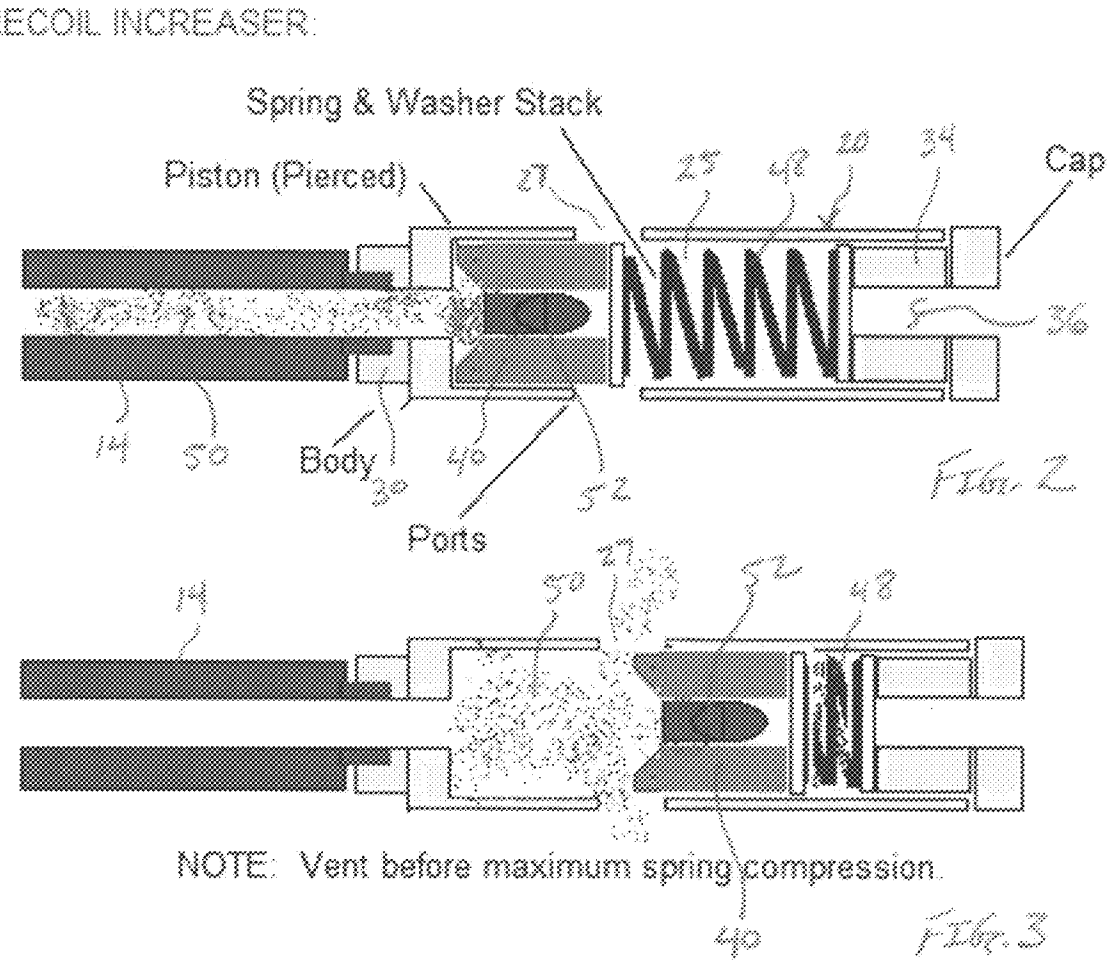
FIG. 2 is a simplified sectional side view of the firearm recoil modifying device of FIG. 1 in an expanded configuration.
FIG. 3 is a simplified sectional side view of the firearm recoil modifying device of FIG. 1 in a compressed configuration.

Turning now to FIGS. 2 and 3, attention is first directed to FIG. 2 which illustrates firearm recoil modifying device 10 with piston 40 in the rearward position. Upon firing of firearm 12, propellant gases 50 push a bullet 52 down barrel 14, through central aperture 32 of adapter 30 and central aperture 46 of piston 40. At this point, bullet 52 obstructs central aperture 46 so that propellant gasses 50 expand into the interior volume 25 between adapter 30 and piston 40. With additional reference to FIG. 3, propellant gases 50 continue to push bullet 52 and additionally engage rearward end 42 of piston 40, pushing piston 40 to the forward position against the bias of the biasing member. At some point, the bias of compression spring 48 overcomes the pushing force of propellant gases against piston 40. Vents 27 can be positioned to relieve the pressure of propellant gases as piston 40 uncovers vents 27. In a preferred embodiment, compression spring 48 prevents piston 40 from impacting end cap 34, and then drives piston 40 rearwardly to impact adapter 30. This impact imparts rearwardly directed forces to barrel 14, simulating recoil. Additionally, as piston 40 reaches the forward position, the downward oriented vents 27 (in the preferred embodiment) release the expanding gases to force muzzle 15 to rise. In combination, these effects simulate centerfire cartridge recoil with the far less powerful and more inexpensive rimfire training round.

It will be understood that firearm recoil modifying device 10 can be employed to increase the recoil of large cartridges as well. Firearm recoil modifying device 10 used with centerfire cartridges would provide exaggerated recoil for use in developing shooting training techniques designed to inure users to the effects of normal centerfire recoil.

Firearm recoil modifying device 10 can be modified to allow piston 40 to make contact with end cap 34 on firing. This is accomplished by providing a much weaker biasing member. The biasing member does not overcome the forces generated by the expansion of gasses. In this case, the biasing member is completely collapsed, resulting in an impact. One this occurs, the bias is sufficient to return the piston 40 to the rearward position. The resulting impact will impart a forward force to barrel 14 that effectively counters the force of recoil by pushing forward on barrel 14 as the firing impulse occurs. As piston 40 reaches the forward position, upward oriented vents 27 force muzzle 15 to depress. In combination, these effects reduce the recoil and muzzle rise.

To further facilitate training using inexpensive firearms, firearm recoil modifying device 10 can also be employed using blank cartridges. The recoil increasing principle of the piston and downward facing relief vent may be adapted to the firing of blank ammunition with increased operating pressure for the weapon and simulated recoil by removing central aperture 46 in piston 40 and/or end cap 34. In the blank firing application, piston 40 may be modified to form a "bullet trap" composed of a hole in the rear of the piston facing the muzzle designed to receive bullet 52 in the event of a live round or rounds being loaded accidentally during training. Should live rounds be fired with the recoil modification device configured as a blank firing adapter in place, a sharp difference in the forward impulse will be evident to warn the user to cease firing due to the increased pressure of service ammunition and the impact on piston 40 of bullet 52. For centerfire applications, the blank adapter shall be heavily constructed to safely vent firing gases and receive multiple live rounds without allowing projectiles to exit the device. The blank cartridge modification maintains the pressure needed to simulate recoil through cycling of the piston and prevents the accidental firing of live ammunition.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A firearm recoil modifying device Comprising:

a cylindrical body having a rearward end, a forward end, and a longitudinal axis extending therebetween, the cylindrical body defining an interior volume;

an adapter, having a rearward end for coupling to a muzzle of a firearm and a central aperture aligned with the longitudinal axis, the adapter coupled to the rearward end of the cylindrical body;

an end cap coupled to the forward end of the cylindrical body, the end cap includes a central aperture aligned with the central aperture of the adapter along the longitudinal axis;

a piston carried within the interior volume of the cylindrical body for reciprocal movement between a rearward position and a forward position, the piston includes a rearward end, a forward end, and a central aperture extending therethrough from the rearward end to the forward end and aligned with the central apertures of the adapter and the end cap, along the longitudinal axis; and a biasing member capable of storing energy at a maximum level during movement of the piston to the forward position and releasing the stored energy to bias the piston to the rearward position, resulting in an impact between the piston and the adapter, the piston moved from the rearward position to the forward position by a force generated by expanding gasses, the force generated by expanding gasses is less than the maximum energy storage level of the biasing member, preventing impact of the piston with the end cap.

2. A firearm recoil modifying device as claimed in claims 1 wherein the biasing member is a compression spring captured within the interior volume between the forward end of the piston and the end cap.

3. A firearm recoil modifying device as claimed in claim 2 wherein the end cap is adjustably coupled to the forward end of the cylindrical body to allow adjustment of preloading tension on the compression spring to increased or decreased recoil.

4. A firearm recoil modifying device as claimed in claim 1 further including vents extending through the cylindrical body from the interior volume to an exterior environment to vent combustion gasses from the interior volume to the exterior.

5. A firearm recoil modifying device as claimed in claim 4 further including a vent blocking sleeve moveable to selectively block the vents to direct the combustion gasses, up, down, to one or both sides or to close them entirely.

6. A firearm recoil modifying device as claimed in claim 4 wherein the vents are exposed, allowing egress of the gases, when the piston is in the forward position.

7. A firearm Comprising:

a barrel having a muzzle;

a recoil modifying device coupled to the firearm barrel at the muzzle, the recoil modifying device comprising:

a cylindrical body having a rearward end, a forward end, and a longitudinal axis extending therebetween, the cylindrical body defining an interior volume;

an adapter, having a rearward end removably coupled to a muzzle of a firearm and a central aperture aligned with the longitudinal axis, the adapter coupled to the rearward end of the cylindrical body;

an end cap coupled to the forward end of the cylindrical body, the end cap includes a central aperture aligned with the central aperture of the adapter along the longitudinal axis;

a piston carried within the interior volume of the cylindrical body for reciprocal movement between a rearward position and a forward position, the piston includes a rearward end, a forward end, and a central aperture extending therethrough from the rearward end to the forward end and aligned with the central apertures of the adapter and the end cap, along the longitudinal axis; and a biasing member capable of storing energy at a maximum level during movement of the piston to the forward position and releasing the stored energy to bias the piston to the rearward position, resulting in an impact between the piston and the adapter, the piston moved from the rearward position to the forward position by a force generated by expanding gasses, the force generated by expanding gasses is less than the maximum energy storage level of the biasing member, preventing impact of the piston with the end cap.

8. A firearm as claimed in claims 7 wherein the biasing member is a compression spring captured within the interior volume between the forward end of the piston and the end cap.

9. A firearm as claimed in claim 8 wherein the end cap is adjustable coupled to the forward end of the cylindrical body to allow adjustment of preloading tension on the compression spring to increased or decreased recoil.

10. A firearm as claimed in claim 7 further including vents extending through the cylindrical body from the interior volume to an exterior environment to vent combustion gasses from the interior volume to the exterior.

11. A firearm as claimed in claim 10 further including a vent blocking sleeve moveable to selectively block the vents to direct the combustion gasses, up, down, to one or both sides or to close them entirely.

12. A firearm as claimed in claim 10 wherein the vents are exposed, allowing egress of the gases, when the piston is in the forward position.

13. A method of modifying recoil of a firearm comprising the steps of:

providing a firearm having a barrel with a muzzle;

providing a firearm recoil modifying device comprising:

a cylindrical body having a rearward end, a forward end, and a longitudinal axis extending therebetween, the cylindrical body defining an interior volume;

an adapter, having a rearward end, a central aperture aligned with the longitudinal axis, the adapter coupled to the rearward end of the cylindrical body;

an end cap coupled to the forward end of the cylindrical body, the end cap includes a central aperture aligned with the central aperture of the adapter along the longitudinal axis;

a piston carried within the interior volume of the cylindrical body for reciprocal movement between a rearward position and a forward position, the piston includes a rearward end, a forward end, and a central aperture extending therethrough from the rearward end to the forward end and aligned with the central apertures of the adapter and the end cap, along the longitudinal axis; and a biasing member capable of storing energy at a maximum level during movement of the piston to the forward position and releasing the stored energy to bias the piston to the rearward position, resulting in an impact between the piston and the adapter, the piston moved from the rearward position to the forward position by a force generated by expanding gasses, the force generated by expanding gasses is less than the maximum energy storage level of the biasing member, preventing impact of the piston with the end cap.;

attaching the rearward end of the adapter to the barrel at the muzzle;

firing the firearm to generate combustion gasses with a force which is less than the maximum level at which energy is stored by the biasing member and move the piston from the rearward position to the forward position; and moving the piston from the forward position to the rearward position with the biasing member.

14. A method of modifying recoil of a firearm as claimed in claim 13 further comprising the steps of:

providing vents extending through the cylindrical body from the interior volume to an exterior environment; and venting the combustion gasses from the interior volume to the exterior when the piston is moved to the forward position.

15. A method of modifying recoil of a firearm as claimed in claim 13 wherein the step of moving the piston from the forward position to the rearward position with the biasing member includes the piston impacting the adapter to impart rearwardly directed forces to the barrel, simulating recoil.

16. A method of modifying recoil of a firearm as claimed in claim 15 further including the step of adjusting the preloading tension on the biasing member to increase or decrease an impact force of the piston impacting the adaptor.

17. A method of modifying recoil of a firearm as claimed in claim 13 wherein the step of moving the piston to the forward position includes the piston impacting the end cap to impart forwardly directed forces to the barrel, reducing recoil.

* * * * *